US006425520B1

(12) United States Patent
Peterson

(10) Patent No.: US 6,425,520 B1
(45) Date of Patent: Jul. 30, 2002

(54) BEVERAGE CARRIER

(75) Inventor: Christine L. Peterson, Batavia, OH (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 09/695,586

(22) Filed: Oct. 24, 2000

(51) Int. Cl.[7] ..... B65D 5/468
(52) U.S. Cl. ..... 229/117.13; 229/117.12
(58) Field of Search ..... 229/117.12, 117.13, 229/920; 206/141, 427

(56) References Cited

U.S. PATENT DOCUMENTS

| | | | | | |
|---|---|---|---|---|---|
| 3,933,303 | A | * | 1/1976 | Kirby, Jr. | 229/117.13 |
| 4,331,289 | A | | 5/1982 | Killy | |
| 4,538,759 | A | | 9/1985 | Dutcher | |
| 5,221,041 | A | | 6/1993 | Stout et al. | 229/117.13 |
| 5,246,112 | A | | 9/1993 | Stout et al. | 206/427 |
| 5,297,725 | A | | 3/1994 | Sutherland | 229/117.13 |
| 5,320,277 | A | | 6/1994 | Stout et al. | 229/117.13 |
| 5,379,944 | A | * | 1/1995 | Stout et al. | 229/117.13 |
| 5,427,307 | A | * | 6/1995 | Campbell | 229/117.12 |
| 5,480,091 | A | * | 1/1996 | Stout | 229/920 |
| 5,482,203 | A | | 1/1996 | Stout | 229/117.13 |
| 5,647,483 | A | | 7/1997 | Harris | 206/427 |
| 5,873,515 | A | * | 2/1999 | Dunn et al. | 229/117.13 |
| 5,996,883 | A | | 12/1999 | Bates | 229/117.13 |
| 6,065,590 | A | | 5/2000 | Spivey | 206/141 |
| 6,129,266 | A | | 10/2000 | Oliff et al. | 229/117.13 |
| 6,131,803 | A | | 10/2000 | Oliff et al. | 229/117.13 |

* cited by examiner

*Primary Examiner*—Gary E. Elkins
(74) *Attorney, Agent, or Firm*—Ostrager Chong & Flaherty LLP

(57) ABSTRACT

An improved paperboard beverage carrier, made from a unitary blank, is disclosed having an improved carrying handle. The carrying handle comprises a longitudinal strap having three plies of paperboard material extending longitudinally across the top of the carrier and downward over and affixed to the carrier end walls. Hand hold apertures are provided either side of the three ply strap and include tear directing cuts whereby inadvertent tear lines from the hand hold apertures are directed into the three ply strap.

23 Claims, 6 Drawing Sheets

BEVERAGE CARRIER

FIELD OF THE INVENTION

The present invention relates to a paperboard carton or carrier, made from a unitary paperboard blank, for carrying a multiplicity of beverage cans, or bottles. More particularly the present invention relates to an improved integral handle by which such carriers are carried by the end user.

BACKGROUND OF THE INVENTION

Beverage containing cans or bottles are typically sold in multiple quantities packaged in paperboard containers or cartons provided with a handle by which the consumer may conveniently carry the package. Such handles are typically formed by providing two, side by side, slots cut into the top wall of the container whereby the consumer typically inserts their fingers into the slots to pick up and carry the carton.

Such beverage carriers are typically formed from a unitary paperboard blank having predetermined score, cut, and perforated lines thereon whereby the blank may be formed into a flat preform, that is convenient for shipping, and which is later errected into a container for receipt of a multiplicity of beverage containing cans therein. Many differing types of paperboard containers and methods of preparing them are well known in the industry.

Typically such paperboard beverage carriers are designed for a one time use and therefore must be low cost. Thus a lightweight, relatively thin, paperboard stock is typically selected for such containers. However, such light weight material is easily torn. Therefore various structural designs including strategically placed score, cut, and perforated lines have been created to provide, and/or improve the structural integrity of such containers.

The one area of most vulnerability to tearing is the carrier handle by which the container is carried. Many prior art designs have been devised including various reinforcing structures, aperture configurations and positions, stress directing fold and/or score lines and stress reliving slits, cut lines and the like. For example see, U.S. Pat. No. 5,826,782 issued to James T. Stout, entitled "Carton And A Handle Therefore" on Oct. 27, 1998; and U.S. Pat. No. 5,906,313 issued to James R. Oliff, entitled "Carton And A Handle Therefore" on May 25, 1999.

Although many prior art handle designs have been previously proposed, a continuing need exists to develop improved handles having improved performance and reliability.

SUMMARY OF THE INVENTION

It is an object of the present invention to provide an improved construction for a paperboard beverage carrier.

It is another object of the invention to provide an improved paperboard beverage carrier made from a unitary paperboard blank.

It is a further object of the present invention to provide a paperboard carrier having an improved carrying handle.

According to the invention, a carton is formed from a unitary sheet of paperboard material for carrying therein a multiplicity of beverage containers. The carton includes a rectangular bottom panel having opposed longitudinal edges and opposed lateral edges. A first and second rectangular side panel has opposed longitudinal edges and lateral edges. One of the side panels is attached to each longitudinal edge of the bottom panel at one of the longitudinal edges the one of the side panels. A first rectangular top panel portion has first and second opposing longitudinal edges and a pair of opposed lateral edges. The first top panel portion is attached to the longitudinal edge of the first side panel. A second rectangular top panel portion has first and second opposing longitudinal edges and a pair of opposed lateral edges. The second top panel portion is attached to the longitudinal edge of the second side panel. The second top panel portion has a longitudinal reinforcing strip attached to its second longitudinal edge whereby the reinforcing strip is folded back over the top panel portion and adhesively affixed thereto thereby providing a double ply of paperboard material along the second longitudinal edge of the second top portion. The first top panel portion overlies the second top panel portion and is adhesively affixed thereto thereby forming the top panel of the carton whereby a longitudinally extending strip of triple ply paperboard material is provided at the juncture of the first and second top panel portions. A hand-hold in the top panel has at least one aperture in the top panel disposed along one side of the triple ply strip.

Also according to the invention, the hand-hold comprises an oval shaped aperture longitudinally disposed along one side of the triple ply strip. The hand-hold comprises a pair of oval shaped apertures, adjacent one another and positioned such that the triple ply strip of paperboard material lies between the apertures.

Further according to the invention, the top panel includes arcuate score lines extending from each longitudinal end of the apertures and extending toward the nearest corner of the carton. Each arcuate score line terminates with a pair of diverging score lines one directed toward the nearest longitudinal edge of the top panel and the other directed toward the nearest lateral edge of the top panel.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawings. The drawings are intended to be illustrative, and not limiting. Although the invention will be described in the context of these preferred embodiments, it should be understood that it is not intended to limit the spirit and scope of the invention to these specific embodiments.

DETAILED DESCRIPTION OF THE INVENTION

As used herein, a "score line" is a rupturing of the surface of the blank paperboard sheet material, typically resulting in a depression on one side of the sheet and a welt on the other, which facilitates the paperboard material being folded or otherwise yield or deform along the line.

As used herein, a "cut line" is a cut which extends completely through the material of the paperboard.

As used herein, a "perforation" is a series of short, separated, cut lines, typically along a straight or curved line, extending completely through the material of the paperboard, facilitating tearing along the line by the end user.

As used herein, a "perforated score line" is a score line having intermediate cuts positioned along the score line, or may be further described as a perforated line having score line portions between the perforations.

Figure 5:
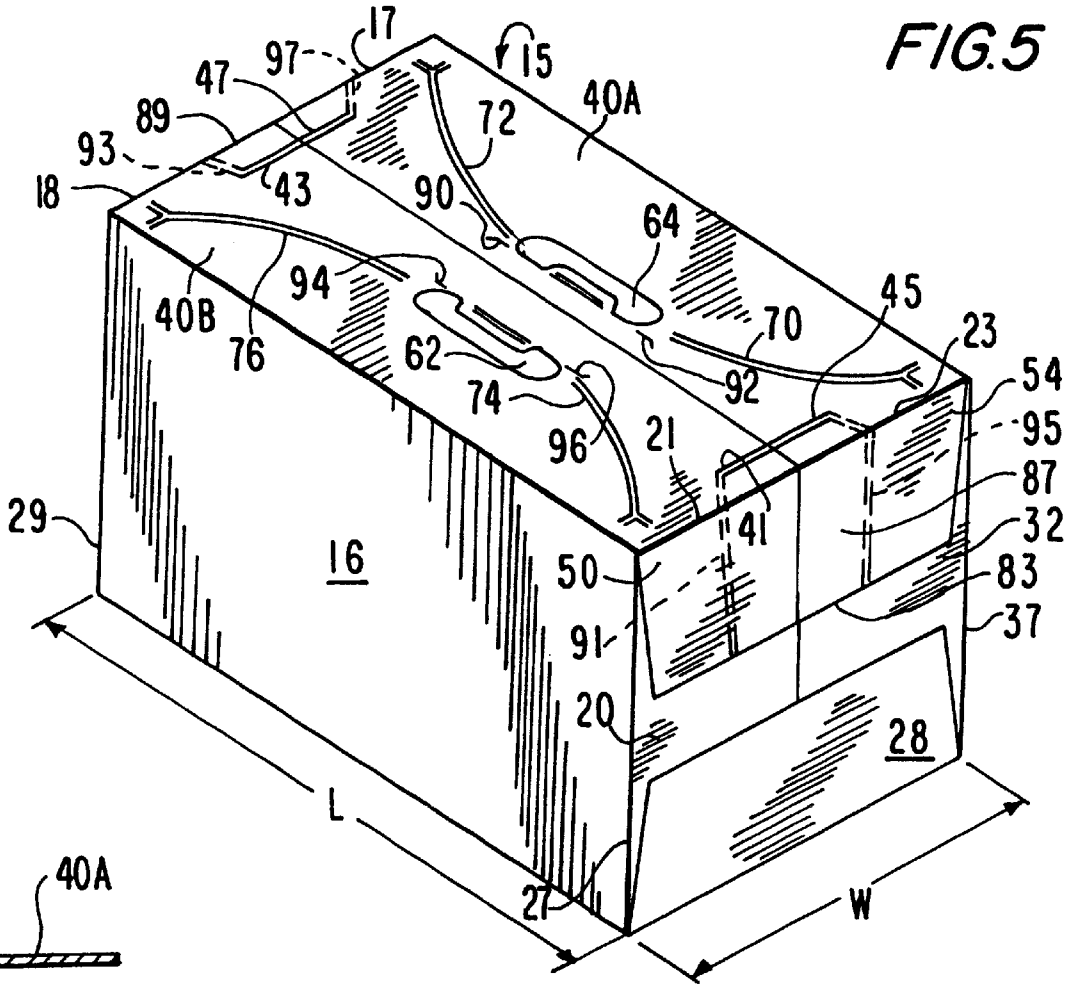
FIG. 5 is a perspective view of the container fully errected with the end flaps closed after a multiplicity of beverage containers have been inserted therein.

As used herein the term "longitudinal" refers to the lengthwise "L" direction of the beverage carton as indicated in FIG. 5.

As used herein the term "lateral" refers to the width direction "W" of the beverage carton as indicated in FIG. 5.

Figure 1:
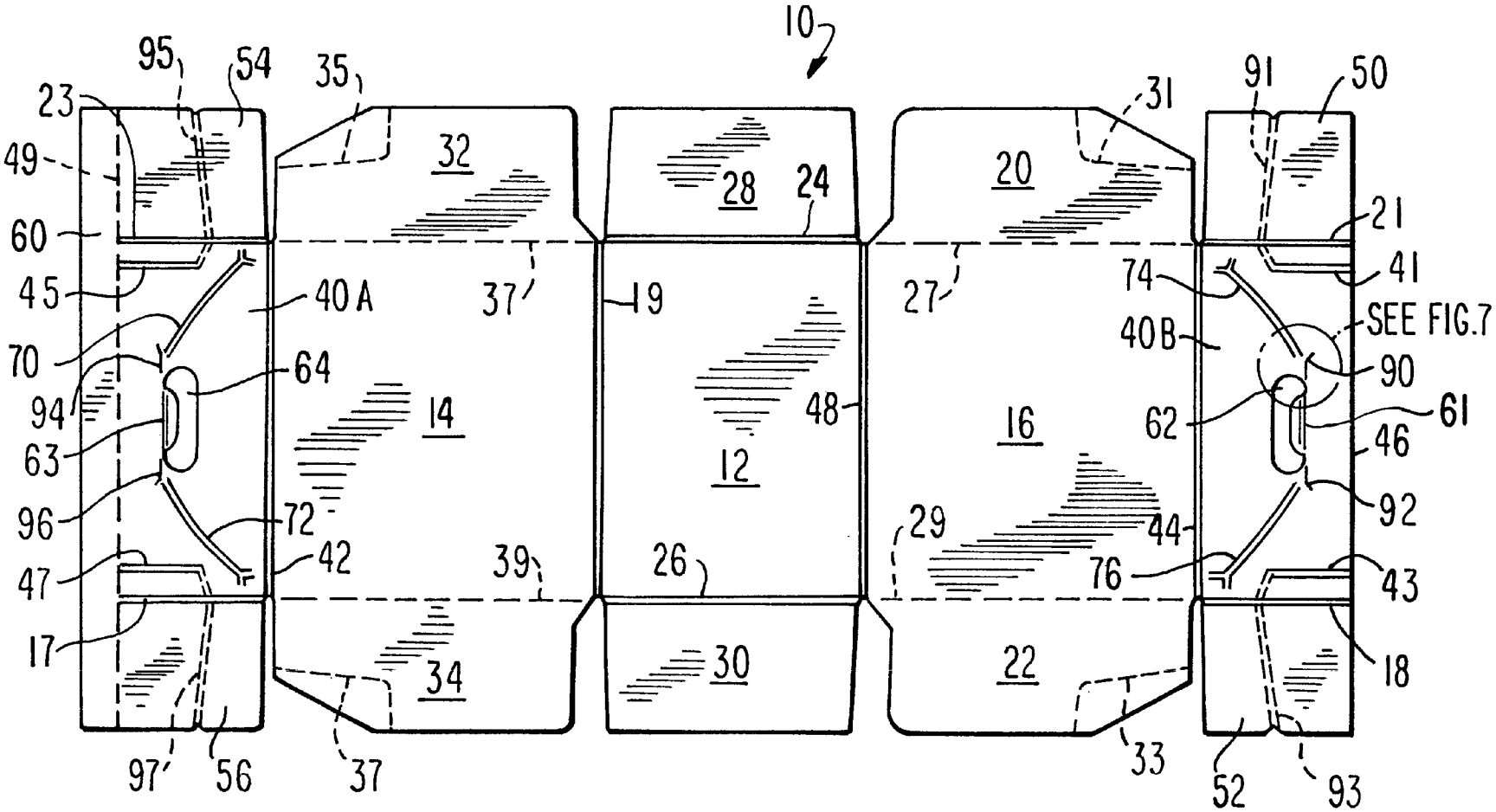
FIG. 1 is a plan view of a paperboard blank for a beverage carrier according to the present invention.

Referring now to the figures, FIG. 1 presents a paperboard blank 10 from which a beverage carrier embodying the present invention may be formed. Blank 10 typically comprises a bottom panel 12 (defined by lateral score line edges 24 and 36, and longitudinal score line edges 19 and 48), two side panels 14 (defined by lateral score line edges 37 and 39, and longitudinal score line edges 19 and 42) and 16 (defined by lateral score line edges 27 and 29, and longitudinal score line edges 44 and 48). End closing flaps 20 and 22 are separated from side panel 16 and 14 by lateral perforated score lines 27 and 29. Similarly bottom end closing flaps 28 and 30 are separated from bottom panel 12 by lateral score lines 24 and 26 respectively. End closing flaps 32 and 34 are separated from side panel 14 by lateral perforated score lines 37 and 39 respectively. Top panel portions 40A (defined by lateral score line edges 17 and 23, and longitudinal score line edge 42) and 40B (defined by lateral score line edges 18 and 21, and longitudinal score line edge 44) are separated from side panels 14 and 16 by longitudinal score lines 42 and 44 respectively. End closing flaps 50, 52, 54, and 56 are separated from top panel portions 40B and 40A by lateral score lines 24 and 26 as illustrated in FIG. 1.

Top panel portion 40A includes a fold over handle reinforcing strip 60 extending the full longitudinal length of top panel portion 40A, plus flaps 54 and 56, as illustrated in FIG. 1. Further, top panel portions 40A and 40B include oval apertures 62 and 64, which ultimately form the carton hand hold. Also included in top panel portions 40A and 40B are a pair of outwardly curved lines 70, 72, 74 and 76 extending from approximately the inner edge of apertures 62 and 64 toward the corners of top panel portions 40A and 40B respectively, as illustrated in FIG. 1. Each of the curved lines 70, 72, 74 and 76 preferably terminate with a pair of short, diverging score lines each terminating short of the panel's intersecting edge lines.

Figure 7:
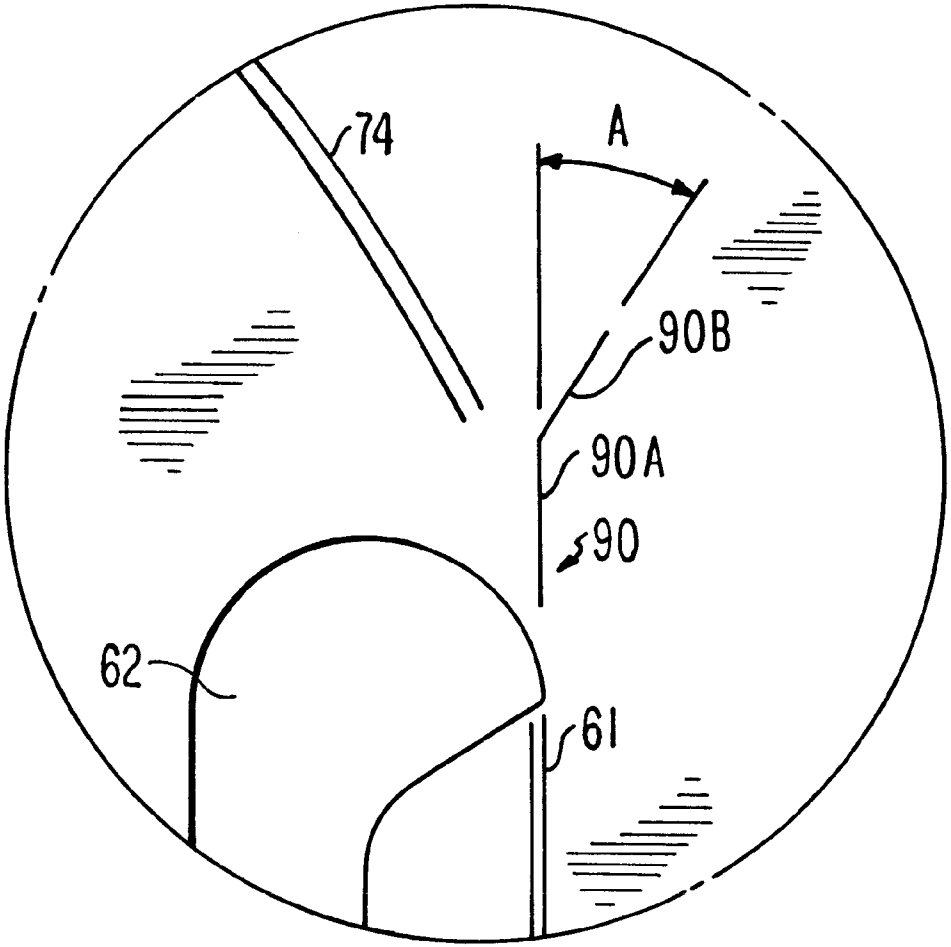
FIG. 7 is an enlarged plan view of the circled area in FIG. 1.

Extending outwardly from each hand hold aperture 62 and 64 and along the extended line of the inner edge 61 and 63 of the apertures are a pair of cut lines 90, 92, 94 and 96 respectively as illustrated in the figures. For clarity, FIG. 7 presents an enlarged view of the circled area in FIG. 1 showing cut line 90 and the immediately surrounding area. Cut lines 92, 94, and 96 are similar to that of cut line 90.

Referring to FIG. 7, cut line 90 comprises a first portion 90A extending outwardly and coincident with the extended line of aperture inner edge 61. A second portion 90B, of cut line 90, diverges inwardly at an angle "A". Angle "A" may be between thirty (30) and forty-five (45) degrees, however angle "A" is preferably set at thirty (30) degrees. The purpose and function of cut lines 90, 92, 94, and 96 will be described further below.

End closing flaps 50, 52, 54, and 56 are provided with a double perforated line 91, 93, 95, and 97 as illustrated in FIGS. 1, 2, 3, and 4. Double perforated lines 91, 93, 95, and 97 extend from the end closing flap's outer edge, beyond score lines 17, 18, 21, and 23 terminating at score lines 41, 43, 45, and 47 respectively as illustrated in FIGS. 1, 2, 3, 4, and 5. The purpose and function of double perforated lines 91, 93, 95, and 97 in conjunction with score lines 41, 43, 45, and 47 will be further described below.

Figure 2:
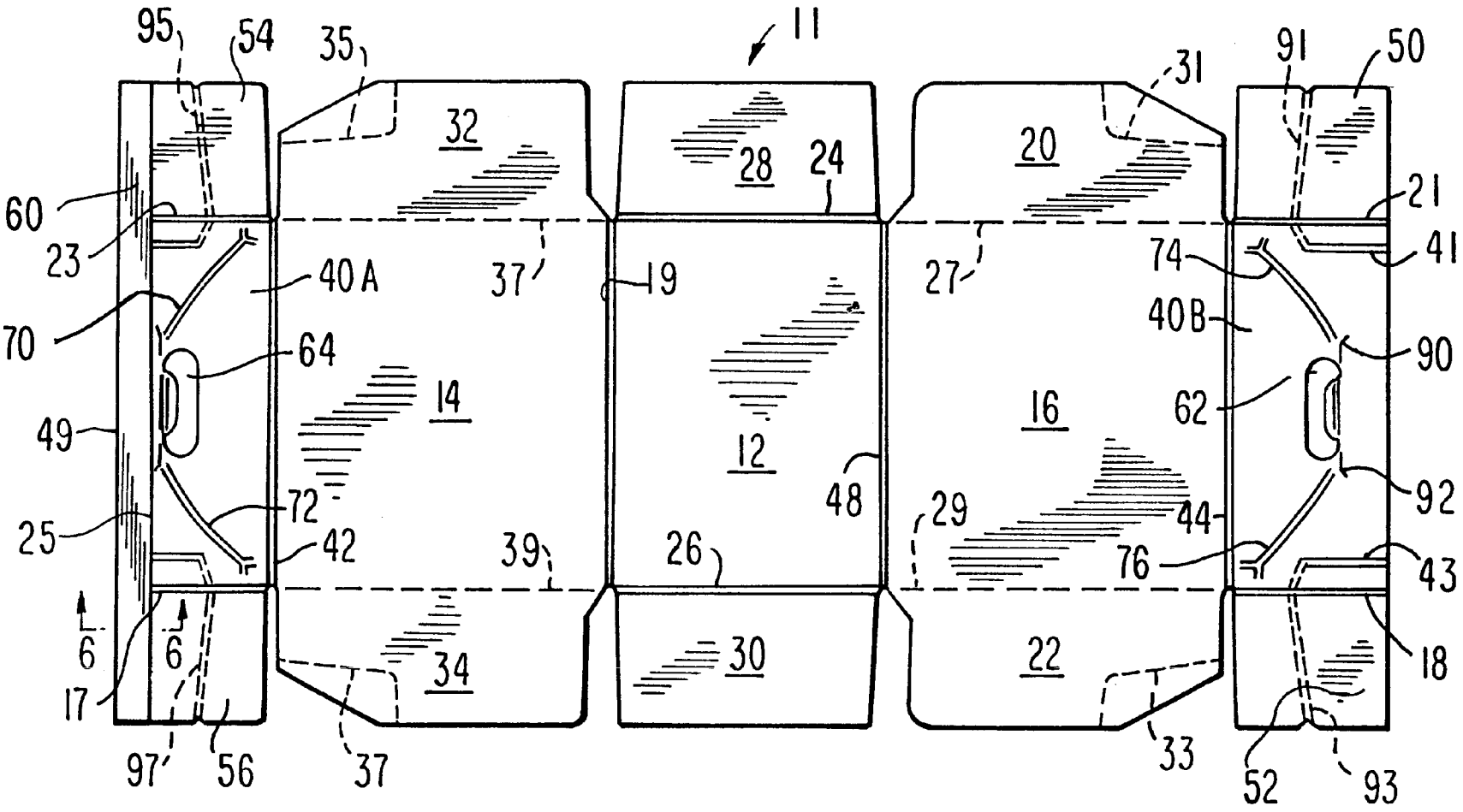
FIG. 2 is the blank as illustrated in FIG. 1 having the first fold wherein a handle reinforcing tab is turned over thereby forming a double layer of paperboard.
Figure 3:
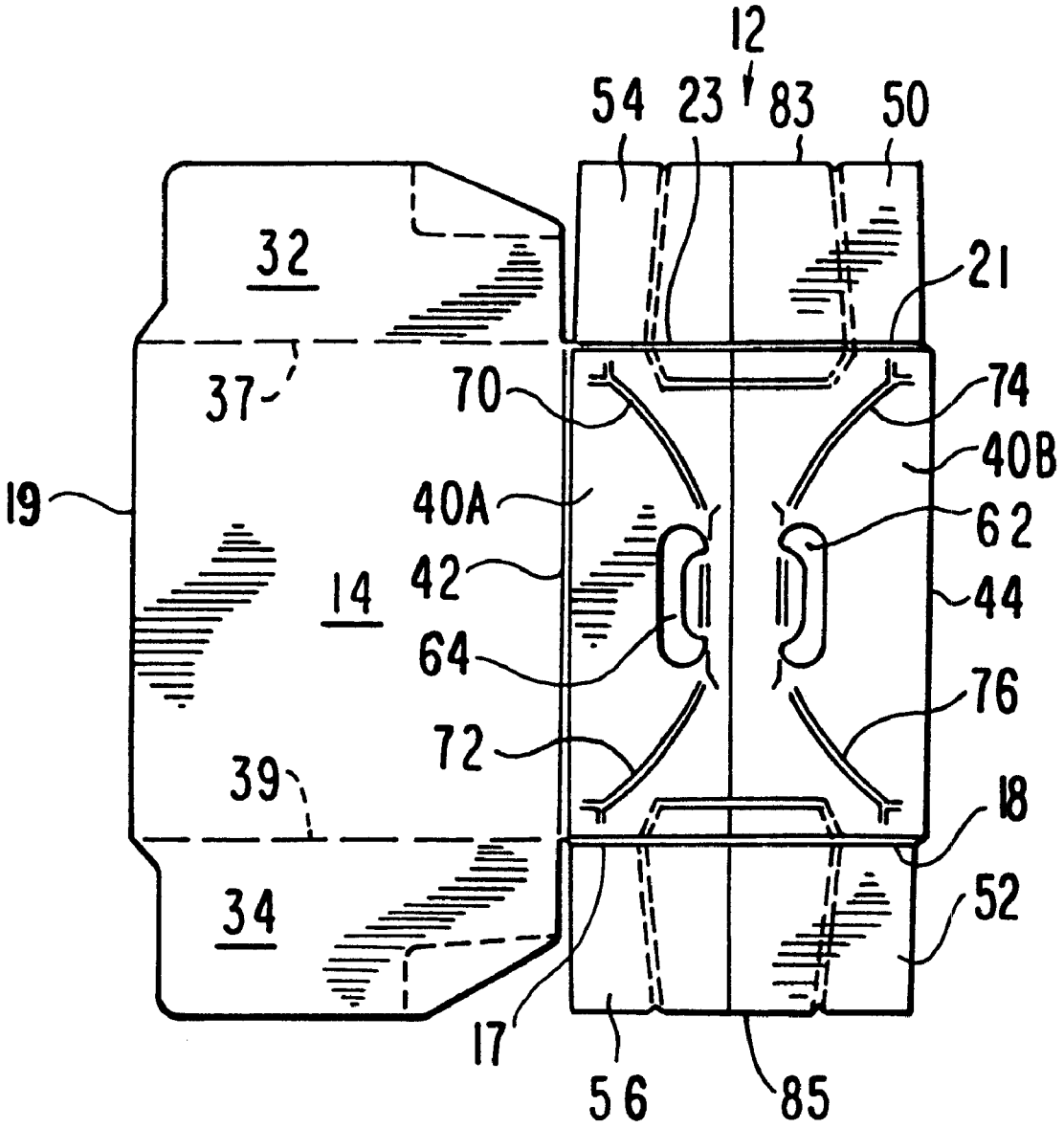
FIG. 3 illustrates the container preform after a second fold is made thereby providing a triple layer of paperboard material in the handle area.

Side panel end closing flaps 20, 22, 32, and 34 include single perforated lines 31, 33, 35, and 37 as illustrated in FIGS. 1, 2, and 3. The purpose and function of perforated lines 31, 33, 35, and 37 will be described further below.

Figure 8:
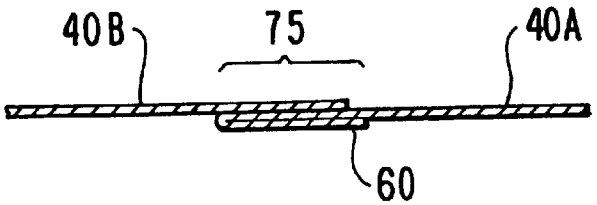
FIG. 8 is a cross-sectional view taken along lines 8—8 in FIG. 4.
Figure 6:
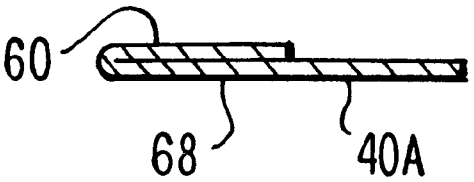
FIG. 6 is a crossectional view taken along line 6—6 in FIG. 2.

Referring to FIGS. 1 and 2, as a first step in forming the carton, a first preform 11, is madeby folding handle reinforcing strip 60 one hundred and eighty (180) degrees about fold line 49, upward out of the plane of FIG. 1, and back over top of top panel portion 40A, and is affixed thereto by any convenient adhesive. FIG. 6 shows a cross section of the reinforcing strip 60 in the folded double paperboard state. The first preform 11 is then folded one hundred and eighty degrees about score line 19, upward out of the plane of FIG. 2 and over top panels 12 and 16. Top panel portion 40B is then folded about score line 44, one hundred and eighty (180) degrees upward out of the plane so as to overlie the folded double paperboard portion 68. Top panel portion 40B is affixed to the double paperboard portion by any convenient adhesive, forming a triple paperboard laminated strip 75, as illustrated in FIG. 8. The triple paperboard laminated strip extends longitudinally from one end of the carton 83 to the other end 85.

Figure 4:
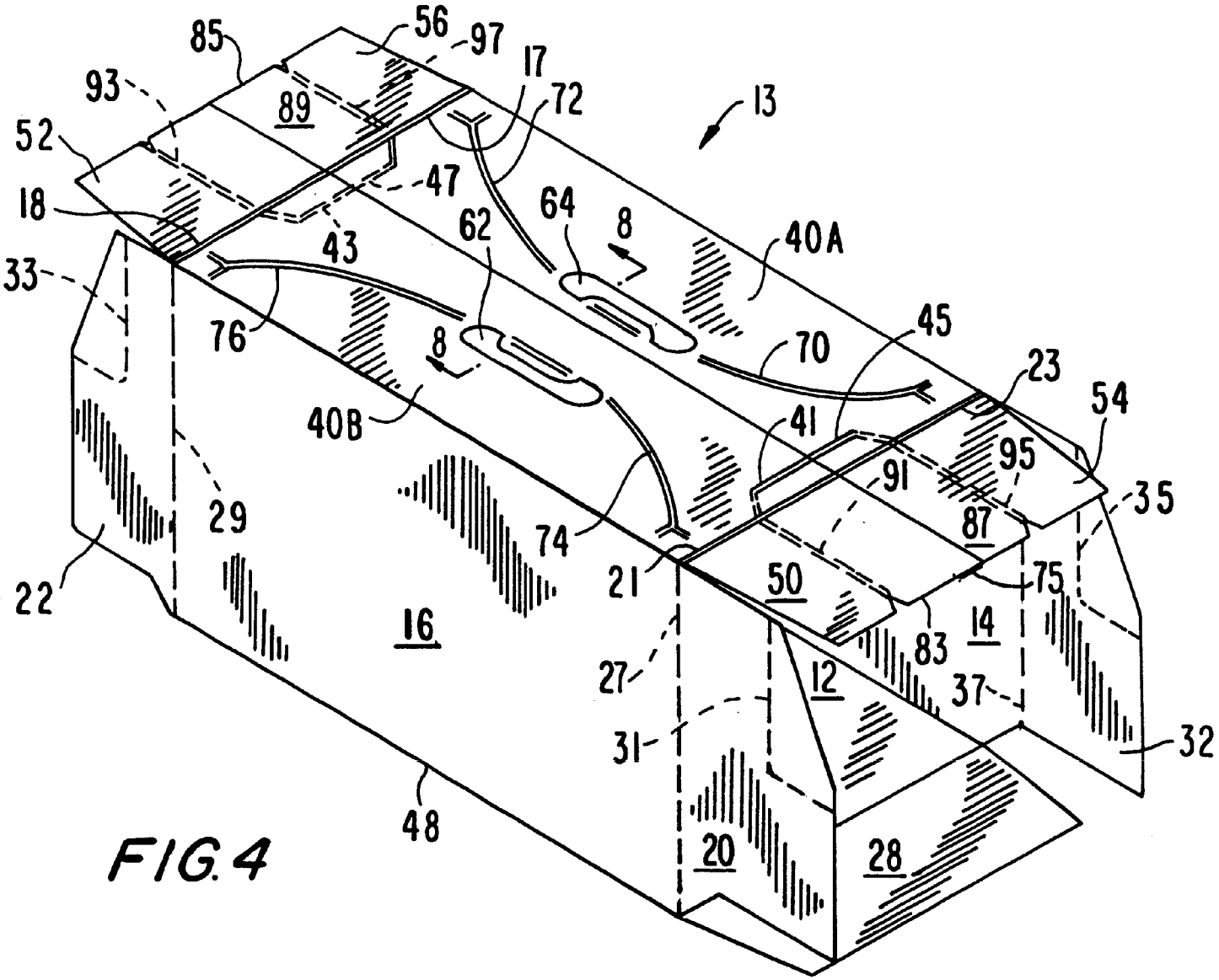
FIG. 4 presents a perspective view of the container preform, as illustrated in FIG. 3, opened and in its errected configuration, with end flaps open, to receive placement of a multiplicity of beverage cans therein.

The carton preform 12, as illustrated in FIG. 3 is the preferred carton configuration for shipment of the carton to the beverage supplier from which the beverage supplier opens and erects preform 12 into the open carton configuration 13 as illustrated in FIG. 4. Once opened, preform 13 is loaded with the appropriate number of beverage cans or bottles and the ends closed and sealed to form the completed package 15 as illustrated in FIG. 5. Preform 13, after being loaded with beverage containers, is closed by first turning inward end closing flaps 20, 22, 32, and 34; bottom flaps 28 and 30 are then turned upward and affixed to end closing flaps 20 and 32, and 22 and 34, respectively, by any convenient adhesive material. End closing flaps 50, 54, 52, and 56 are then turned downward and affixed to end closing flaps 20, 22, 32, and 34 by any convenient adhesive thereby completing the beverage package.

Double perforated lines 91 and 95, and 93 and 97 provide a convenient tear-open flap that may be torn open by grasping the edge 83 and/or 85 and pulling upward ,whereby an access flap 87 and/or 89 is openingly hinged about score line 45 and/or 47 thereby providing easy access to the beverage containers within the package. For added convenience the corners of end closing flaps 20, 22, 32, and 34 may be torn away along perforated lines 31, 33, 35 and/or 37 thereby providing an even more accessible package.

Turning now to FIG. 5, a triple laminated, paperboard, "strap" 75 is formed at the juncture of top panel portion 40A and 40B, see FIG. 8, extending longitudinally across the top of the completed package, between the hand hold apertures 62 and 64 and downward over each end of package 15.

A purchaser of the packaged beverage lifts package 15 by inserting his/her fingers into one or both of the hand hold apertures 62 and 64, grasps the triple ply strap 75 therebetween and lifts the package. Since the end flaps 50, 52, 54, and 56 are adhesively affixed to end closing flaps 20, 22, 32, and 34, respectively, a large portion of the load carried by the triple laminated, longitudinal strap 75 is transferred to the end walls of the package. Further, as the package is lifted by triple ply strap 75, curved score lines 70, 72, 74 and 76 bow upward thereby directing additional stresses applied to the top panel of the package towards the four corners of the package. In the event the hand hold apertures 62 and 64 begin to teat in the longitudinal direction, cut lines 90, 92, 94 and 96 direct the tearing forces in the triple ply strap 75 by virtue of the angled portion 90B thereof, thereby stopping the tear from advancing further.

Although the present invention has been described in connection with a preferred embodiment thereof, many variations and modification will become apparent to those skilled in the art. It is preferred, therefore, that the present invention be limited not by the specific disclosure herein, but only by the following appended claims.

I claim:

1. A carton formed from a unitary sheet of paperboard material, the carton comprising side and bottom walls, and a top panel having:

a first top panel portion (40B) and a second top panel portion (40A) wherein the first top panel portion (40B) overlies the second top panel portion (40A) and adhesively affixes thereto, creating a longitudinally extending paperboard strip at the juncture of the first and second top panel portions;

first and second opposed lateral edges and first and second opposed longitudinal edges;

a hand-hold in the top panel comprising at least one aperture disposed longitudinally along one side of the paperboard strip; and arcuate score lines extending from each longitudinal end of the aperture and extending toward the nearest corner of the carton.

2. The carton according to claim 1, wherein said hand-hold comprises a pair of apertures positioned such that the paperboard strip lies between the apertures.

3. The carton according to claim 1, wherein the arcuate score lines terminate with a pair of diverging score lines, one directed toward the nearest longitudinal edge of the top panel and the other directed toward the nearest lateral edge of the top panel.

4. The carton as claimed in claim 1, wherein the top panel further comprises at least one cut line extending from substantially adjacent the aperture to the paperboard strip.

5. The carton according to claim 4, wherein said at least one cut line comprises a first cut line portion generally parallel the paperboard strip and a continuing, diverging second cut line portion directed toward the paperboard strip.

6. The carton according to claim 5, wherein the second cut line portion diverges from the first cut line portion at an angle between 30 and 45 degrees.

7. The carton according to claim 2, wherein the arcuate score lines terminate with a pair of diverging score lines, one directed toward the nearest longitudinal edge of the top panel and the other directed toward the nearest lateral edge of the top panel.

8. The carton as claimed in claim 2, wherein the top panel further includes at least one cut line extending from substantially adjacent the apertures toward the paperboard strip.

9. The carton according to claim 8, wherein said at least one cut line comprises a first cut line portion generally parallel the paperboard strip and a continuing, diverging second cut line portion directed toward the paperboard strip.

10. The carton according to claim 9, wherein the second cut line portion diverges from the first cut line portion at an angle between 30 and 45 degrees.

11. The carton according to claim 1, wherein the paperboard strip further comprises a longitudinal reinforcing strip (60) to form a triple ply strip.

12. The carton according to claim 1, wherein said first panel portion (40B) further comprises a first pair of end closing flaps (51, 50), and said second top panel portion (40A) further comprises a second pair of end closing flaps (54, 56), wherein the first pair of end closing flaps overlies the second pair of end closing flaps, thereby extending the paperboard strip.

13. The carton according to claim 1, wherein the at least one aperture of the hand-hold comprises an oval shaped aperture.

14. A carton formed from a unitary sheet of paperboard material, the carton comprising side and bottom walls, and a top panel having:

a first top panel portion (40B) and a second top panel portion (40A) wherein the first top panel portion (40B) overlies the second top panel portion (40A) and adhesively affixes thereto, creating a longitudinally extending paperboard strip at the juncture of the first and second top panel portions;

first and second opposed lateral edges and first and second opposed longitudinal edges;

a hand-hold in the top panel comprising at least one aperture in the top panel disposed longitudinally along one side of the paperboard strip; and at least one cut line extending from substantially adjacent the aperture and comprising a first cut line portion generally parallel the paperboard strip and a continuing, diverging second cut line portion directed toward the paperboard strip.

15. The carton according to claim 14, wherein the second cut line portion diverges from the first cut line portion at an angle between 30 and 45 degrees.

16. The carton according to claim 14 wherein, the top panel further includes arcuate score lines extending from each longitudinal end of the aperture and extending toward the nearest corner of the carton.

17. The carton as claimed in claim 14 wherein the top panel further comprises arcuate score lines extending from each longitudinal end of the aperture and extending toward the nearest corner of the carton.

18. The carton according to claim 17 wherein said at least one cut line comprises a first cut line portion generally paralleling the paperboard strip and a continuing, diverging second cut line portion directed toward the paperboard strip.

19. The carton according to claim 18, wherein the second cut line portion diverges from the first cut line portion at an angle between 30 and 45 degrees.

20. The carton according to claim 14, wherein the paperboard strip further comprises a longitudinal reinforcing strip (60) to form a triple ply strip.

21. The carton according to claim 14, wherein said first panel portion (40B) further comprises a first pair of end closing flaps (51, 50), and second top panel portion (40A) further comprises a second pair of end closing flaps (54, 56), wherein the first pair of end closing flaps overlies the second pair of end closing flaps, thereby extending the paperboard strip.

22. The carton according to claim 14, wherein the at least one aperture of the hand-hold comprises an oval shaped aperture.

23. The carton according to claim 14, wherein said hand-hold comprises a pair of apertures, positioned such that the paperboard strip lies between the apertures.

* * * * *